US008839993B2

(12) United States Patent
Peirsman et al.

(10) Patent No.: US 8,839,993 B2
(45) Date of Patent: Sep. 23, 2014

(54) BEVERAGE DISPENSING APPARATUS COMPRISING SELF-REGULATED FLOW CONTROL MEANS

(75) Inventors: Daniel Peirsman, Brussels (BE); Stijn Vandekerckhove, Brussels (BE)

(73) Assignee: Anheuser-Busch Inbev NV, Brussels (BE)

( * ) Notice: Subject to any disclaimer, the term of this patent is extended or adjusted under 35 U.S.C. 154(b) by 22 days.

(21) Appl. No.: 13/636,734

(22) PCT Filed: Mar. 25, 2011

(86) PCT No.: PCT/EP2011/054631

§ 371 (c)(1),
(2), (4) Date: Dec. 5, 2012

(87) PCT Pub. No.: WO2011/120883

PCT Pub. Date: Oct. 6, 2011

(65) Prior Publication Data

US 2013/0098946 A1 Apr. 25, 2013

(30) Foreign Application Priority Data

Mar. 29, 2010 (EP) ..... 10158240

(51) Int. Cl.
*B67D 1/12* (2006.01)

(52) U.S. Cl.
USPC ..... 222/399; 222/394; 29/527.1

(58) Field of Classification Search
CPC ..... B67D 1/12; B67D 1/0406
USPC ..... 222/399, 394, 544, 564; 29/527.1
See application file for complete search history.

(56) References Cited

U.S. PATENT DOCUMENTS 3,178,062 A 4/1965 Welty et al.
3,685,538 A 8/1972 Sullivan (Continued)

FOREIGN PATENT DOCUMENTS

CA 2 338 497 A1 8/2002
CH 416245 A 6/1966

(Continued)

OTHER PUBLICATIONS

International Search Report (in English) for PCT/EP2011/054631, mailed on May 4, 2011; ISA/EP.

*Primary Examiner* — Paul R Durand
*Assistant Examiner* — Donnell Long
(74) *Attorney, Agent, or Firm* — Harness, Dickey & Pierce, PLC

(57) ABSTRACT

Beverage dispensing apparatus comprising a self-regulating flow rate control means (5). It comprises: A pressurized container (30, 31) containing a beverage to be dispensed; A dispensing duct (1) defined by at least one wall and bringing in fluid communication the liquid beverage contained in the container through a first opening (1*a*) with the exterior via a valve (35) and out of a second opening (1*b*), for drawing beverage out of the container. At least a section (3) of the wall defining the dispensing duct is resiliently flexible and is such that its inner surface, facing the interior of the dispensing duct, is exposed to the pressure, P1, reigning in the duct at that level, and its outer surface, facing out of the duct is exposed to a pressure, P2, substantially equal to the pressure reigning in the container, the resiliently flexible section (3) being suitable for maintaining a substantially constant dispensing flow rate over a given range of operating pressure values, P2, in the container.

9 Claims, 5 Drawing Sheets

(56) References Cited

U.S. PATENT DOCUMENTS

| | | | | | |
|---|---|---|---|---|---|
| 3,831,600 | A | * | 8/1974 | Yum et al. | 604/250 |
| 4,191,204 | A | * | 3/1980 | Nehring | 137/205 |
| 4,210,172 | A | * | 7/1980 | Fallon et al. | 137/504 |
| 4,724,870 | A | * | 2/1988 | Molb k et al. | 138/46 |
| 5,199,609 | A | | 4/1993 | Ash, Jr. | |
| 5,240,144 | A | | 8/1993 | Feldman | |
| 6,325,255 | B1 | * | 12/2001 | Lane et al. | 222/396 |
| 2009/0108031 | A1 | | 4/2009 | Anderson | |

FOREIGN PATENT DOCUMENTS

| | | | |
|---|---|---|---|
| DE | 601 933 | C | 9/1934 |
| DE | 10 2007 001 215 | A1 | 10/2008 |
| EP | 0037950 | A1 | 10/1981 |
| FR | 2 426 935 | A1 | 12/1979 |
| GB | 2181214 | A | 4/1987 |
| WO | WO-01/72630 | A1 | 10/2001 |
| WO | WO-2007/019852 | A1 | 2/2007 |
| WO | WO-2007/019853 | A2 | 2/2007 |
| WO | WO-2008/060152 | A1 | 5/2008 |

* cited by examiner (a)

(b)

BEVERAGE DISPENSING APPARATUS COMPRISING SELF-REGULATED FLOW CONTROL MEANS

CROSS-REFERENCE TO RELATED APPLICATIONS

This application is a 371 U.S. National Stage of International Application No. PCT/EP2011/054631, filed on Mar. 25, 2011, which claims priority to European Patent Application No. 10158240.1, filed on Mar. 29, 2010. The contents of the above applications are incorporated herein by reference in their entirety

TECHNICAL FIELD

The present invention relates to a pressurized beverage dispenser comprising flow regulating means for automatically maintaining substantially constant the flow rate of the pressurized beverage out of the container it is stored in as a function of the pressure reigning in the container.

BACKGROUND FOR THE INVENTION

Liquid dispensing devices have been on the market for ages. Many of them rely on a pressurized gas raising the pressure in the interior of a container containing the liquid to be dispensed, in particular a beverage like beer or other carbonated beverages. The container is either prepressurized in plant or the gas is fed upon use either directly into the container containing the liquid like e.g., in U.S. Pat. No. 5,199,609 or between an external, rather stiff container and an inner, flexible vessel (e.g., a bag or a flexible bottle) containing the liquid to be dispensed, like in U.S. Pat. No. 5,240,144 (cf. FIGS. 1(*a*)&(*b*)). Both applications have their pros and cons which are well known to the persons skilled in the art. The present invention applies equally to both types of delivery systems.

The over pressure applied to the container for driving the liquid out thereof is usually of the order of 0.5 to 1.5 bar (above atmospheric). It is clear that the flow of a liquid reaching the dispensing tap at such high pressure could easily become uncontrollable and such sudden pressure drop could lead to the formation of unwanted foam. For this reason, it is often necessary to provide means for controlling the flow of a liquid out of the container and/or for smoothly reducing the pressure thereof between the container it is extracted from and the tap, where it contacts atmospheric conditions. Several solutions have been proposed to solve this problem.

The simplest method for inducing pressure losses between the container and the dispensing tap is to provide a long dispensing line, of a length of about 1 to 5 m. This solution is self evident in most public houses, wherein the kegs are stored in a cellar or next room, connected to the tap by a long line. For smaller systems like home dispensers, however, this solution has drawbacks, such as requiring a specific handling for fitting such long line in a dispensing apparatus, usually coiling it. A substantial amount of liquid remains in the line after each dispensing. Said stagnant liquid is the first to flow out of the tap at the next dispense. This of course has the inconvenience that the beverage stagnant in the dispensing line is not controlled thermally and would result in dispensing e.g., beer at a temperature above the desired serving temperature. A further inconvenient is when changing container, the liquid stagnant in the line may yield serious hygienic concerns and, in case of a different beverage being mounted on the appliance, to undesired flavours mixing. For solving this latter problem, it has been proposed to change the dispensing line each time the container is being changed (cf. e.g., WO2007/019853, dispensing line #32 in FIGS. 35, 37, and 38).

An alternative to increasing the length of the dispensing line for generating pressure losses in a flowing liquid is to vary the cross-sectional area of the line. For instance, it is proposed in WO2007/019852 to provide dispensing lines comprising at least two sections, a first, upstream section having a cross-sectional area smaller than a second, downstream section. Such line can be manufactured by joining two tubes of different diameter, or by deformation of a polymeric tube, preferably by cold rolling. US2009/0108031 discloses a dispensing line comprising at least three sections of different cross-sectional area forming a venturi tube as illustrated in FIGS. 5 and 9 of said application. The dispensing tube described therein is manufactured by injection moulding two half shells each comprising an open channel with matching geometry to form upon joining thereof a closed channel with the desired venturi geometry. In DE102007001215 a linear tube section at the inlet of a pressure reducing duct transitions smoothly into a tubular spiral with progressively increasing diameter, finishing in an outlet opening.

These solutions are interesting but they are not suitable for regulating the flowrate of a liquid when the pressure difference between the container and atmospheric varies over time. Such pressure variations may happen, e.g., in case of prepressurized vessels wherein a given amount of pressurized gas is stored in the container. As the liquid is being dispensed, the free volume in the container increases whilst the amount of gas remains constant, thus resulting in a pressure decrease over time in the container. Similarly, when gas is adsorbed on a carrier or stored in a cartridge of small dimensions, the storage capacity may be insufficient to maintain a constant pressure in the vessel over time. A flow rate controlling means able to maintain the dispensing flow rate substantially constant over a given range of pressures in the container is therefore desirable.

In order to solve this problem, a pressure regulating valve is usually used, wherein a flexible diaphragm biased by resilient means, eg. an helicoidal spring, controls the area of an opening; an old and simple embodiment of such valves is given in DE601933 filed in 1933. These solutions, however, comprise multiple components requiring a separate assembly, thus increasing the cost thereof. An alternative to said valves is to control the cross section of a duct by applying pressure to a flexible section thereof.

For example, in order to provide a more accurate control of the flow rate of a fluid flowing in a duct than made possible by the speed control of a pump, it was proposed in EP0037950 to control the cross-sectional variation of a flexible section of said duct by enclosing said section in a chamber connected to a source of pressurizing medium (air, gas, or liquid) able to apply a pressure to said flexible section of the duct. A similar principle is disclosed in CH416245 and in GB2181214. These solutions, however, require a connection to a pressurizing fluid to control the pressure difference across the flexible section of the duct. Furthermore, these systems do not allow the flow rate to be self-regulated but require the control of the pressure of the pressurizing fluid in the chamber to maintain the flow at the desired rate.

FR2426935 discloses a self regulating system for maintaining the level of a liquid in a reservoir fed by a duct within a desired level by immersing said duct at a given distance from the bottom thereof, said duct comprising a section made of two elastomeric diaphragms bond along their lengths and which separation requires the fluid in the duct to be at a pressure higher than the hydrostatic pressure reigning around said section and which magnitude depends on the level of liquid in the reservoir. Although quite ingenious, this solution designed for mud pits or oil drills cannot be applied to beverage dispensing apparatuses.

A self-regulating closure system to be applied in particular to ducts suitable for oil and gas drilling operations is disclosed in U.S. Pat. No. 3,685,538 wherein a section of the duct consists of a flexible sleeve provided on its outer side with a number of pressing rollers which are displaced along the direction of flow in case of overpressure, said displacement comprising a radial component leading to the occlusion of the sleeve. Here again, this system cannot be applied to beverage dispensing means because it is too complex and expensive (even after scaling down) especially for home appliances.

In the other extreme of the size scale of oil drilling ducts, CA2338497 discloses a self-regulating shunt—a small diameter catheter—to be applied subcutaneously in the head of a patient suffering of hydrocephalus to lead cerebrospinal fluid from the head to another space in the body. The shunt disclosed therein comprises a duct having a flexible sleeve section surrounded by a chamber connected to said duct both upstream and downstream with valve systems to compensate pressure variations when a lying patient stands. The flow rate of cerebrospinal fluid is of the order of the ml/s (0.06 l/min) in a purely laminar flow with Reynolds numbers of the order of 1 to 25, not comparable with the conditions encountered with beverage dispensing apparatuses with flowrates of the order of 0.5 to 2.5 l/min and characterized by a mixture of laminar and turbulent flows with Reynolds numbers comprised between 2000 and 4000 or by turbulent flows with Reynold numbers of up to 15,000 depending on the flow rate and diameter of the dispensing duct.

There therefore remains a need for providing flow rate regulating means in a pressure driven beverage dispensing apparatus which is effective in controlling the flow rate over a large variation of pressure differences, which can be produced economically, and which is compatible with the economics of recycling.

SUMMARY OF THE INVENTION

The present invention is defined in the appended independent claims. Preferred embodiments are defined in the dependent claims.

In particular, the present invention concerns a dispensing apparatus for dispensing a beverage comprising:

A pressurized container containing a beverage to be dispensed;

A dispensing duct defined by at least one wall and bringing in fluid communication the liquid beverage contained in the container through a first opening with the exterior via a valve and a second opening for drawing beverage out of the container, Characterized in that, at least a section of the at least one wall defining the dispensing duct is resiliently flexible and is such that its inner surface, facing the interior of the dispensing duct is exposed to the pressure, $P_1$, reigning in the duct at that level, and its outer surface, facing out of the dispensing duct is exposed to a pressure substantially equal to the pressure, $P_2$, reigning in the container, the resiliently flexible section being suitable for maintaining a substantially constant dispensing flow rate over a given range of operating pressure values, $P_2$, in the container.

In preferred embodiments, the flexible section may be in the form of any of:

(a) A tubular sleeve joining two relatively rigid sections of the dispensing duct;

(b) A flexible sheet closing an open window on the at least one wall defining the dispensing duct;

(c) Two or more such windows closed by a flexible sheet distributed, preferably regularly, along the periphery of a given section of the dispensing duct.

And wherein the at least one wall defining the dispensing duct at and adjacent the flexible section may comprise planar or curved sections.

The dispensing duct may advantageously comprise a drawing stem penetrating in the container. With this configuration, it is possible to locate the flexible section within the container, advantageously as a tubular sleeve forming a continuous, flexible section of the duct.

Althernatively, the flexible section may be located outside the container. In this case the flow rate controlling means should further comprise a blind duct having an opening in fluid communication with the interior of the container and sharing at least a wall with the dispensing duct including the flexible section thereof. The flexible section may be in the form of a sheet or a tubular sleeve. The blind, duct advantageously surrounds and is preferably substantially concentric with the dispensing duct. The container generally comprises a closure, through which passes the dispensing duct and the flexible section of the dispensing duct may be located either within or downstream from said closure. In these embodiments, the opening to the container of the blind duct is preferably substantially flush with the surface of the closure facing the interior of the container.

The dispensing apparatus of the present invention is particularly suitable as a disposable home beer dispenser.

The present invention also concerns a method for producing a flow control means for controlling the flow rate of a liquid flowing through a dispensing duct of a pressure driven beverage dispensing apparatus, said method comprising the following steps:

Injection moulding two half bodies of a housing, each half body comprising on their inner surface at least one open channel matching at least one open channel of the other half;

Bringing the two half bodies, with optionally other elements in between, in abutting relationship with the at least one open channel of one half body vis-à-vis the at least one open channel of the other half body to thus form at least one through duct having a first and second openings and a second, blind duct having a single opening;

Joining the two half bodies and optional other elements therebetween to yield first and second fluid tight channels;

Characterized in that, the first through duct and the second, blind duct share a common wall, including a section thereof being resiliently flexible.

The optional other elements may be either (a) a flexible material forming the flexible section in the form of a sheet or a tubular sleeve, or (b) a dispensing duct comprising a flexible section.

BRIEF DESCRIPTION OF THE FIGURES

For a fuller understanding of the nature of the present invention, reference is made to the following detailed description taken in conjunction with the accompanying drawings in which.

DETAILED DESCRIPTION OF THE INVENTION

Figure 1:
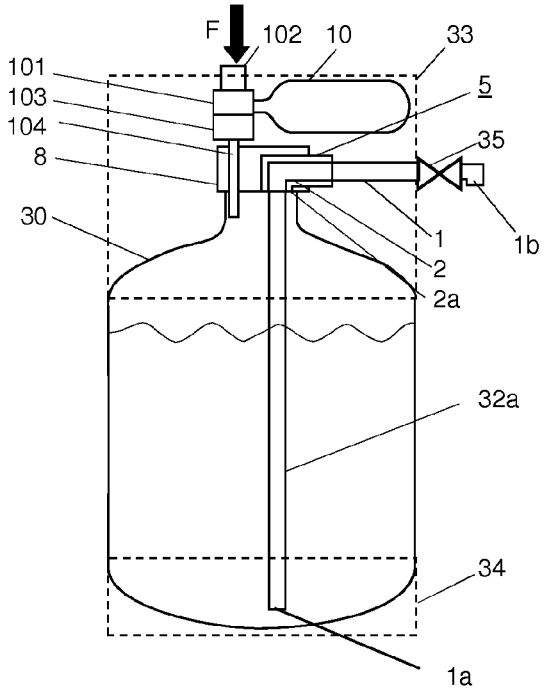
FIG. 1: shows two embodiments of a pressurized beverage dispenser according to the present invention.
Figure 1:
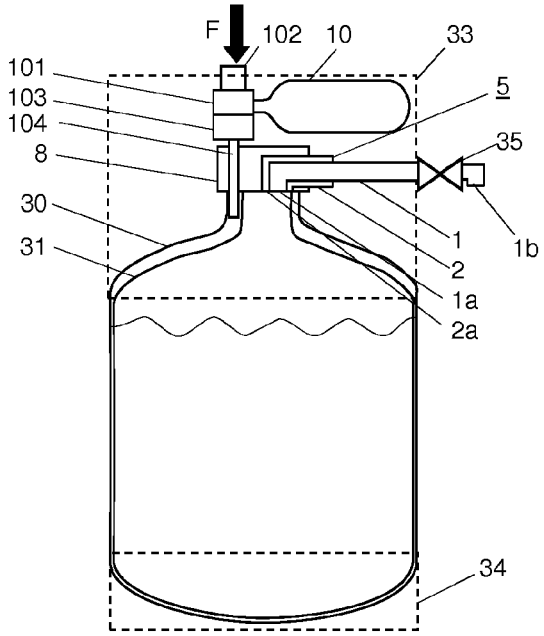

FIG. 1 shows two alternative embodiments of liquid dispensing devices according to the present invention. The design of the devices depicted in FIG. 1 is representative of disposable home dispensing devices, typically for beer, but the invention is not limited to these types of appliances, and can, on the contrary, be applied to any type of beverage pressure driven dispensing apparatus. In both embodiments of FIG. 1, the dispensing of a liquid, generally a beverage like a beer or a carbonated soft drink, is driven by a pressurized gas contained in a gas cartridge (10). Upon piercing of the closure of the pressurized gas cartridge (10) by actuation by an actuator (102) of a piercing unit (101), the gas contained in the cartridge (10) is brought into fluid communication with the container (30), often at a reduced pressure via a pressure regulating valve (103). In FIG. 1(*a*) the gas is introduced through the gas duct (104) directly into the container (30) and brought into contact with the liquid contained therein, whilst in the embodiment depicted in FIG. 1(*b*), the gas is injected at the interface between an outer, rather rigid container (30) and a flexible inner container or bag (31) containing the liquid. In this latter embodiment, the gas never contacts the liquid to be dispensed.

Other solutions can be applied to pressurize the liquid contained in the container (30, 31) and the present invention can be applied to any. For example, a compressor can be used, which has the advantage of ensuring a constant pressure over time, but is obviously more expensive, quite bulky, and generates noise. In short, a compressor is seldom used in home beverage appliances but rather in public houses or the like, where the dispensed volumes are higher. Alternatively, a gas can be adsorbed or absorbed on a carrier preferably characterized by a high specific surface, said gas being released upon any change of the environmental physical conditions, such as pressure or temperature (cf. e.g., WO2008060152). The beverage may also be pre-pressurized in plant by adding into the container (30) a compressed gas, either in contact with the liquid to be dispensed or separated therefrom by a flexible inner bag (31) and sealingly closing the container. This latter solution has the disadvantage that pressure may drop over time and the pressure upon dispensing may be unpredictable in case the container is stored for a long time with risks of leaks or too high a gas permeability.

A top chime (33) generally made of plastic, such as polypropylene, serves for aesthetic as well as safety reasons, to hide and protect from any mishandling or from any impact the dispensing systems and pressurized gas container. A bottom stand (34) generally made of the same material as the top chime (33) gives stability to the dispenser when standing in its upright position. The container is generally closed by a closure (8), which is not necessarily removable, in particular in case of disposable appliances.

In both embodiments depicted in FIG. 1, the pressure in the vessel (30, 31) increases to a level of the order of 0.5 to 1.5 bar above atmospheric (i.e., 1.5 to 2.5 bar) and forces the liquid through the channel opening (1*a*), along the dispensing duct (1) to reach the tap (35) and downstream thereof, an opening (1*b*) to ambient. In case of traditional containers as depicted in FIG. 1(*a*) (i.e., comprising no bag in the container) the dispensing tube (1) comprises a drawing stem (32*a*) extending into the container down to the lower level thereof to draw the last drops of beverage contained therein. In the case of bag-in-containers as illustrated in FIG. 1(*b*), however, the use of a drawing stem (32*a*) is not mandatory since the bag (30) collapses upon pressurization of the volume comprised between the bag (31) and the container (30), thus leaving no empty volume in the bag and allowing the beverage to contact the channel opening (1*a*) without necessarily requiring a drawing stem (32*a*). A drawing stem (32*a*) is sometimes used anyway to help controlling the collapse of the bag and preventing the formation of closed pockets.

Figure 4:
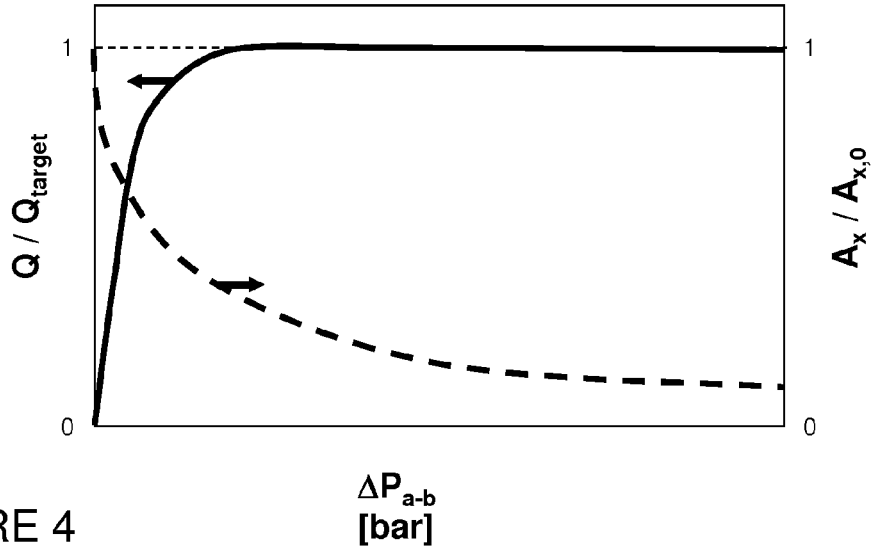
FIG. 4: shows schematically the regulation of the normalized flow rate, $Q/Q_{target}$, as well as the evolution of the normalized cross-section area, $A_x/A_{x,0}$, of the flexible section, as a function of the pressure difference ($\Delta P_{a-b}$) from one end to the other of the dispensing duct.

In order to control the pressure and rate of the flowing liquid reaching the open tap (35, 1*b*) at atmospheric pressure, flow control means (5) are interposed between the two openings (1*a*, 1*b*) of the dispensing duct (1). The flow control means (5) useful for the present invention are of a very simple and economical design which makes them particularly suitable for being implemented in home appliances, where low production costs are a major driving factor. They have the great advantage of permitting to maintain the dispensing flow rate at a substantially constant value even when the pressure in the container varies with time over a given range as illustrated in FIG. 4. For this reason, such flow rate controlling means are sometimes said to be "self-regulating".

The self-regulating principle of the flow rate control means (5) useful in the present invention is very simple. A section (3) of the dispensing tube (1) is made flexible, such that the inner surface of the flexible section facing the interior of the dispensing tube (1) is exposed to a pressure, $P_1$, reigning in the duct at that level, and the outer surface, facing out of the duct (1) is exposed to a pressure substantially equal to the pressure, $P_2$, reigning in the container (30, 31). When the valve (35) is closed, the pressures $P_1$ and $P_2$ in the dispensing duct and the container, respectively, are substantially equal, $P_1=P_2$, and the flexible section (3) of the dispensing duct (1) is at rest (cf. position 3*a* in FIG. 2). Upon opening of the valve (35), a pressure gradient, $\Delta P_{a-b}$, is created between the first opening (1*a*) of the dispensing duct (1) which is at a pressure, $P_2$, and the second opening (1*b*) which is at atmospheric pressure, thus driving the flow of beverage out of the container. Consequently, the pressure, $P_1$, in the dispensing duct (1) at the level of the flexible section (3) becomes lower than the pressure, $P_2$, reigning in the container (30, 31) creating a pressure gradient, $\Delta P_{2-1}$, across the flexible wall (3) of the duct (1). Consequently, the flexible wall section will be strained to a geometry (3*b*) such that the cross-section area of the dispensing tube (1) is reduced in this region, thus reducing the flow rate, Q, of the beverage flowing through the dispensing duct (1). Now, in case the pressure, $P_2$, varies with time for any reason (generally $P_2$ will decrease with time in cases such as discussed below, but it may increase too) the pressure gradient, $\Delta P_{a-b}$, between inlet (1*a*) and outlet (1*b*) of the dispensing duct (1) will vary accordingly, and so will the pressure gradient, $\Delta P_{2-1}$, across the flexible wall section (3) of the dispensing duct (1), resulting in a corresponding variation of the cross section area in this region. This mechanism is illustrated in FIG. 4 which plots the relative flow rate, $Q/Q_{target}$, relative to the desired flow rate value, $Q_{target}$, as well as the relative cross-section area, $A_x/A_{x,0}$, of the dispensing duct at the flexible region (3) with respect to the rest cross-section area, $A_{x,0}$, of the duct in the absence of any pressure gradient, $\Delta P_{2-1}$, as a function of the pressure difference, $\Delta P_{a-b}=P_2-P_{atm}$.

By adequately selecting the materials, geometry, and position of the flexible section (3) a substantially constant flow rate, Q, can be maintained over the range of variations of the pressure, $P_2$, in the container (30, 31) over the period to required to empty the container from its content. The range of variations of the pressure, $P_2$, in the container depends mostly on the pressurization mode of the container. In case of pre-pressurization by in-plant injection of pressurized gas or in case of gas being adsorbed or absorbed on a porous carrier, the pressure, $P_2$, in the container may vary from 10 bar before use down to 0.3 bar overpressure after the last drop being dispensed. The pressure range may vary from 8 to 0.5 bar, or 5 to 1 bar. In case of a small pressurized cartridge (10) integrated in the apparatus as depicted in FIG. 1, the pressure may vary from 2 to 0.3 bar overpressure from the first to the last dispensing, in particular 1.5 to 0.5 bar overpressure depending on the cartridge capacity. In case a compressor or a pressurized gas bottle of large capacity are used, no substantial pressure variation is expected over time, although sudden surges of pressure may happen especially between two activations of the compressor, if the latter is controlled by a hand throttle.

Figure 3:
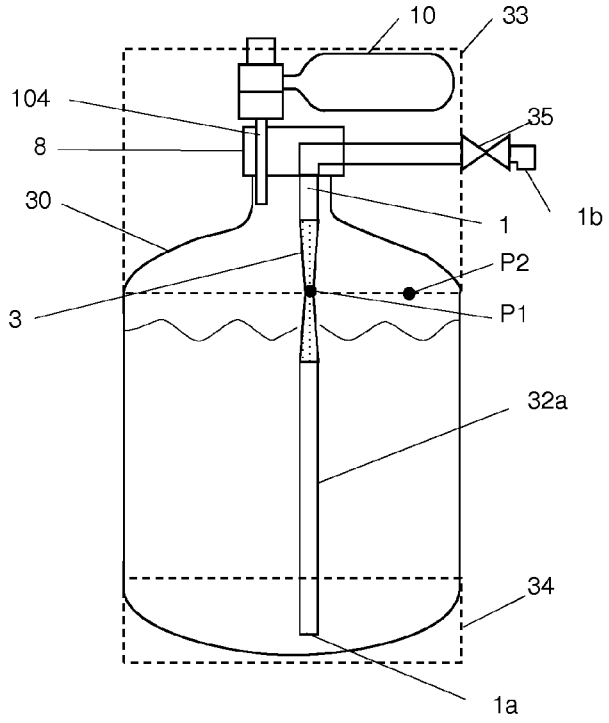
FIG. 3: shows another embodiment of an apparatus according to the present invention.
Figure 6:
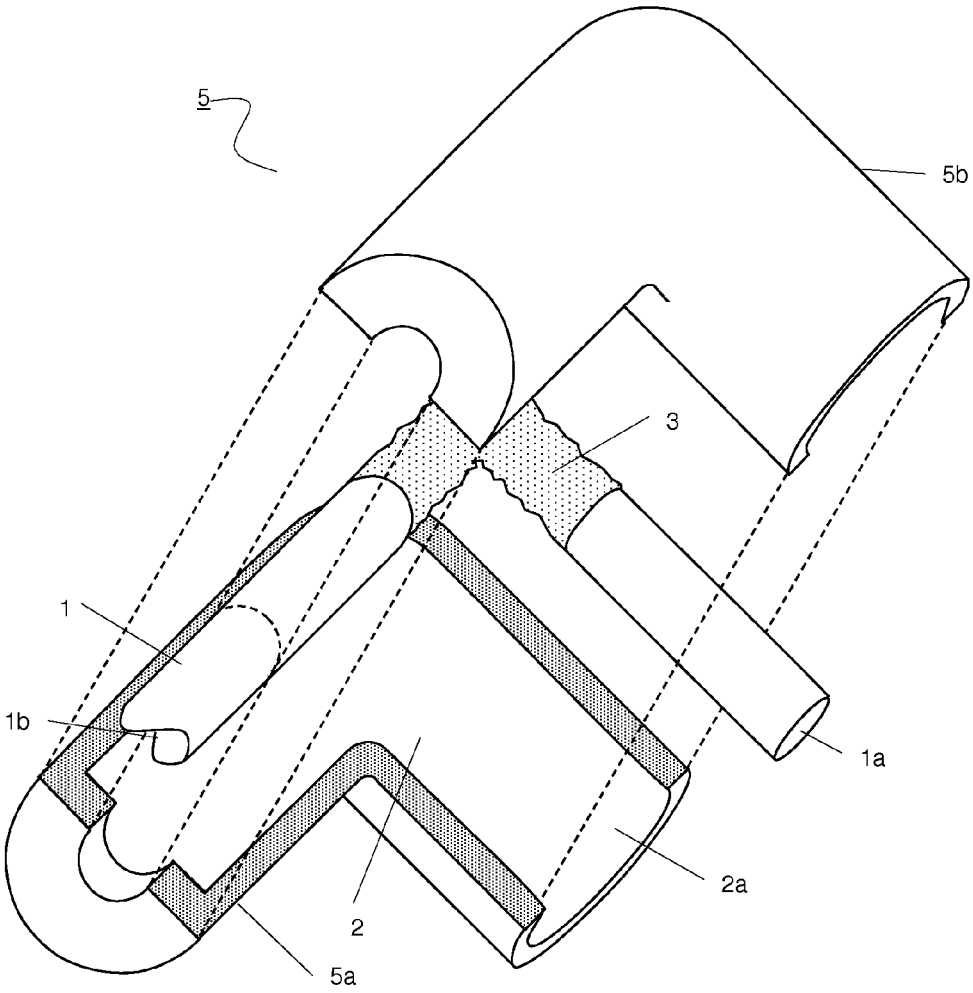
FIG. 6: shows schematically how an alternative flow regulator suitable for the present invention may be manufactured.

In particular, the flexible section (3) may be in the form of any of:

(a) A tubular sleeve joining two relatively rigid sections of the dispensing duct (1); this geometry is depicted in FIGS. 3 and 6 and is advantageous in that upon a pressure gradient, $\Delta P_{1-2}$, the cross section is restricted radially and this embodiment is relatively easy to manufacture.

Figure 2:
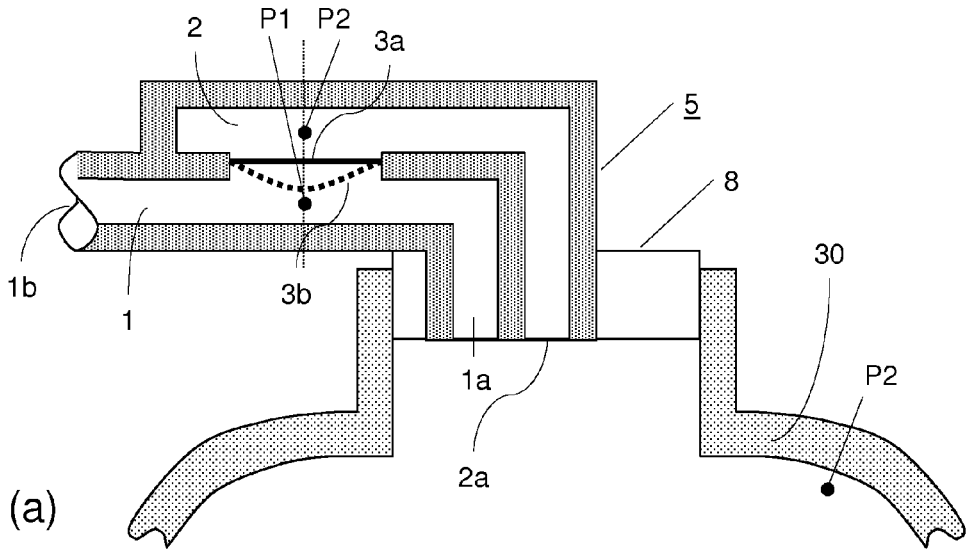
FIG. 2: shows two embodiments of a flow regulating device suitable for the apparatus of the present invention.
Figure 2:
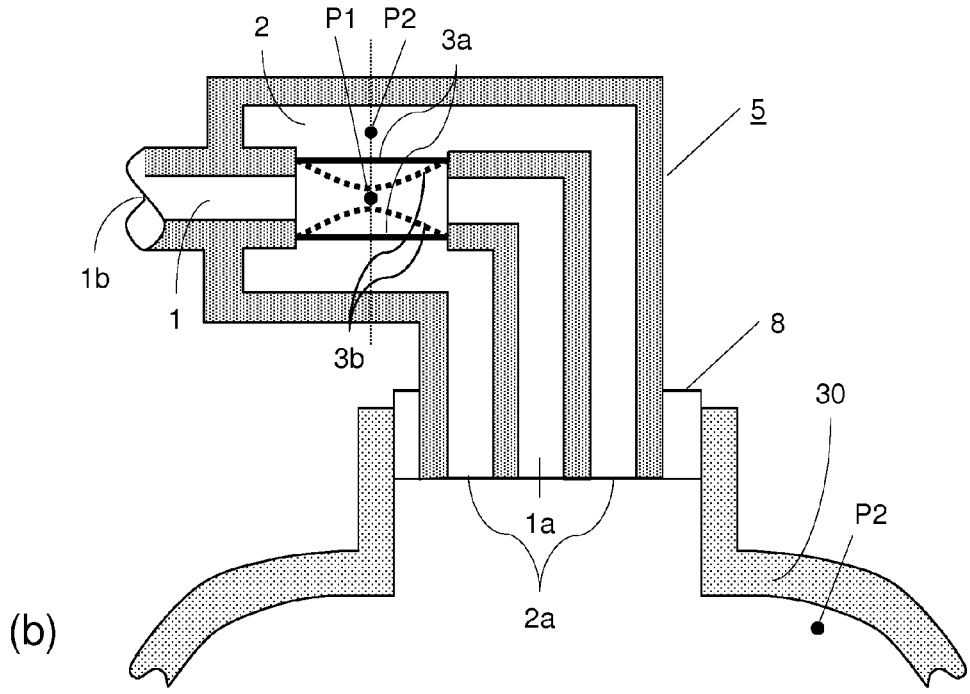
Figure 5:
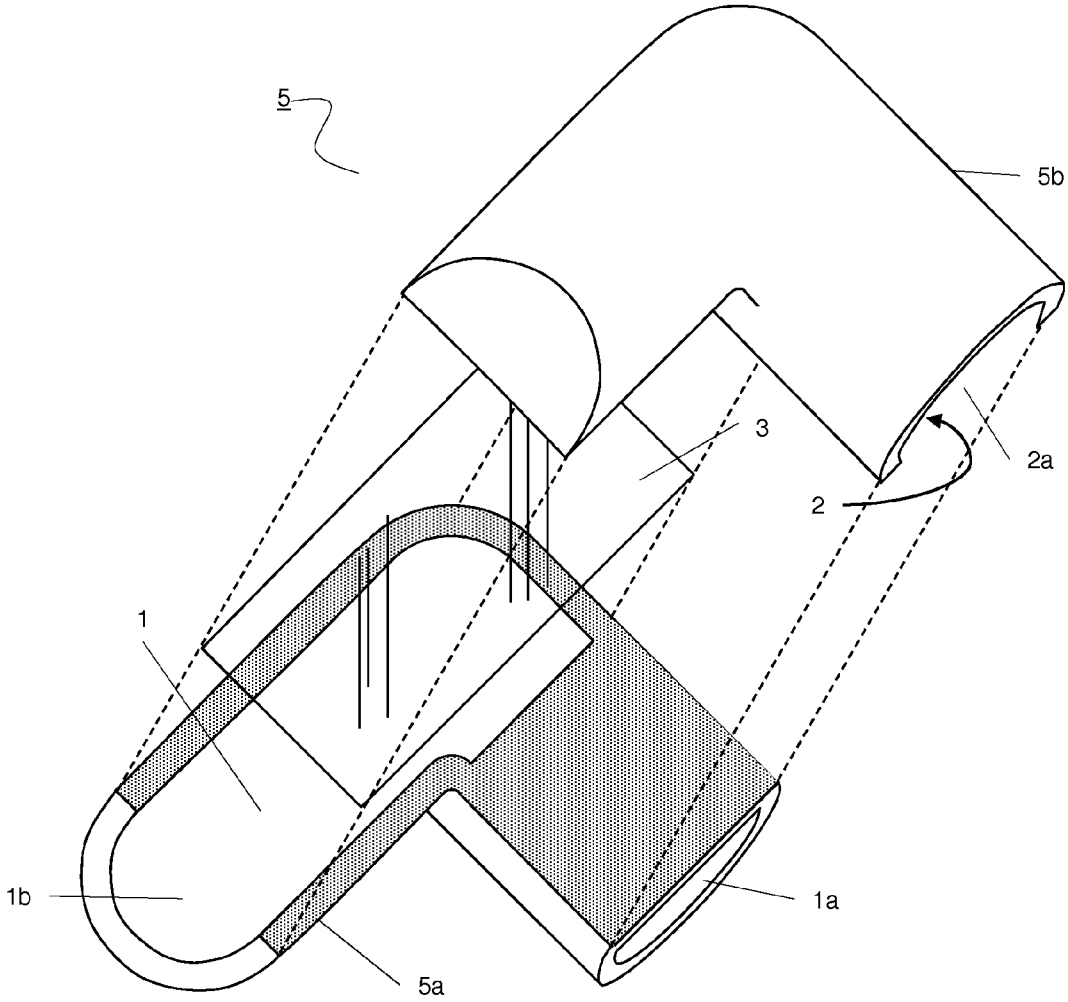
FIG. 5: shows schematically how a flow regulator suitable for the present invention may be manufactured.

(b) A flexible sheet closing an open window on the at least one wall defining the dispensing duct (1); this geometry is illustrated in FIGS. 2(*a*) and 5 and may require the use of highly deformable materials for the flexible section to allow for the duct cross-sectional variations required to maintain the flow rate constant over a broad pressure range; the manufacturing of this embodiment, however, is advantageously simple, an example of which being shown in FIG. 5;

(c) Two or more such windows closed by a flexible sheet distributed, preferably regularly, along the periphery of a given section of the dispensing duct; this geometry is a compromise between the two previous geometries (a) and (b) and allows for the use of less deformable materials as geometry (b) since in case of e.g., two opposed windows, the material deformation required to reduce the cross sectional area of the duct is thus reduced by half.

In any of the preceding geometries, the at least one wall defining the dispensing duct (1) at and adjacent the flexible section (3) may comprise planar or curved sections. In the case of a tubular sleeve, curved sections are of course preferred.

The flexible section (3) may be positioned anywhere along the dispensing duct (1) between its inlet (1*a*) and its outlet (1*b*). In particular, if the dispensing tube (1) comprises a drawing stem (32*a*) penetrating in the container, the flexible section (3) can be positioned on the drawing stem (32*a*). This geometry has the advantage of allowing a very simple design, wherein a section of the stem (32*a*) is replaced by a flexible tubular sleeve (3) as illustrated in FIG. 3. Here again, it should be stressed that the geometry and materials of the tubular sleeve shall be properly selected and designed so as to obtain the desired flow rate control effect. For example, using any rubber hose, e.g., as type used for watering gardens as a drawing stem would not allow a control of the flow rate in the pressure variation ranges encountered in pressure driven beverage dispensing apparatuses. Since the pressure gradient, $\Delta P_{2-1}$, across the flexible wall section increases from zero up to $(P_2-P_{atm})$ as the distance of the flexible section (3) to the inlet (1*a*) of the dispensing duct (1) increases, the pressure gradient, $\Delta P_{2-1}$, with this solution is limited by the length of the drawing stem (32*a*). This is a drawback of this embodiment since it is easier to control the cross-section area of the flexible section (3) with larger pressure gradients, $\Delta P_{2-1}$. A solution to this problem is to provide the dispensing duct (1) with means for inducing pressure losses downstream of the flexible section (3), such as variations of the cross section of the duct (1) forming, e.g., a Venturi type geometry, bends, surface structure of the inner wall, or corrugation, care being taken especially with beer dispensers to avoid forming too much froth.

Alternatively, the flexible section (3) may be located on the dispensing tube (1) outside of the container (30, 31). This geometry would be mandatory for dispensers comprising no drawing stem (32*a*) penetrating in the container (cf. FIG. 1(*b*)). In this case, the simple design discussed in the preceding paragraph and illustrated in FIG. 3 does not work anymore, since the outer surface of the flexible section (3) would thus not be exposed to a pressure substantially equal to the one, $P_2$, reigning in the container, but rather to a pressure close to atmospheric. In this case, the flow rate control means (5) comprise a second, blind duct (2) having an opening (2*a*) in fluid communication with the interior of the container (30, 31) but, unlike the dispensing duct (1), no opening in fluid communication with ambient. The second duct (2) shares at least one wall with the dispensing duct (1) including the flexible section (3) thereof as illustrated in FIG. 2. The pressure in the second, blind duct (2) is substantially equal to the pressure, $P_2$, reigning in the container (30, 31).

The container is normally closed with a closure (8). The flexible section (3) of the dispensing duct (1) may be located either at least partly within the closure (8) as depicted in FIG. 1, or between the closure (8) and the outlet (1*b*), as depicted in FIG. 2 (the valve (35) Is not shown for clarity). As discussed above, the advantage of locating the flexible section (3) outside of the container rather than on the drawing stem (32*a*), if any (!), is that the pressure gradient, $\Delta P_{2-1}$, across the flexible wall section (3) is higher the further away it is located from the dispensing duct inlet (1*a*).

The dispensing duct (1) and the second duct (2) may be adjacent and sharing a substantially flat or slightly curved wall, comprising the flexible section (3) as illustrated in FIGS. 2(*a*) and 5. On the other hand, the second duct (2) may surround and preferably be concentric with the dispensing duct (1). The opening (2*a*) to the container of the blind duct (2) is preferably substantially flush with the surface of the closure (8) facing the interior of the container (30, 31). The same applies with the inlet (1*a*) of the dispensing duct (1) in case this one does not comprise a drawing stem (32*a*). There may be a single or several second, blind ducts (2) and their openings (2*a*) towards the container (30, 31) may preferably be parallel to the first opening (1*a*) of the dispensing duct (1).

Outside of the flexible section (3), the dispensing duct (1) may have any geometry: it could be straight, or bent; it may have a constant or a varying cross section forming, e.g., a Venturi type geometry, and the cross section could be circular or at least curved, or may be polygonal comprising one or several flat walls forming corners at their interception lines. A section (3) of at least one wall of the first duct (1) is made of a resiliently flexible material. Suitable materials for section (3) are natural or synthetic rubbers, silicone resins, thermoplastic elastomers (TPE), or the section may be made of the same material as the at least one wall of the dispensing duct (1) but of substantially thinner section. The resiliently flexible section (3) may be planar in case it is located on a planar wall or may be curved if the wall itself is curved. In particular, the section (3) may be in the form of a flexible tubular sleeve sealingly connecting two end sections of the dispensing duct (1) as illustrated in FIGS. 2(*b*), 3, and 6. Depending on their design, the dispensing duct (1) of many appliances comprises a substantially 90 degree bend at the level of the closure or shortly downstream thereof as illustrated in FIGS. 1 and 2. Advantage can be taken by the use of a flexible sleeve to locate the bend at the level of the flexible section (3) as depicted in FIG. 6. Care must be taken that the flexible sleeve does not get pinched at the bend resulting in the occlusion of the dispensing duct (1).

The flow rate controlling means (5) described above are very simple, comprising few components and no moving part. They are very effective for self regulating the flow rate regardless of the pressure, $P_2$, in the container. The pressure range over which the flow rate can effectively be self regulated depends on the geometry and position of the regulating means, such as the diameter of the ducts (1, 2), their cross sectional geometry, the size, geometry and thickness of the flexible section (3), the material used for the flexible wall section of the dispensing duct (1), etc. It is a routine work for a person skilled in the art to design a flexible section (3) of the dispensing duct such that the flow rate remains substantially constant over the pressure range encountered with a given type of dispensing apparatus. In particular, the cross-section area, $A_x$, of the flexible section (3) of the dispensing duct required for reaching a target flow rate, $Q_{target}$, as a function of the pressure, $P_2$, in the container, can easily be calculated depending on the type of flow: laminar, mixture of laminar and turbulent, or turbulent. Once this relationship is known, designing the flexible section can easily be done as a function of the mechanical properties of the flexible material and of the expected pressure gradients $\Delta P_{a-b}$.

The flow control means (5) suitable for the present invention may be manufactured by a method comprising the following steps:

Injection moulding two half bodies (5*a*, 5*b*) of a housing, each half body comprising on their inner surface at least one open channel matching at least one open channel of the other half;

Bringing the two half bodies, with optionally other elements in between, in abutting relationship with the at least one open channel of one half body vis-à-vis the at least one open channel of the other half body to thus form at least one through duct (1) having a first and second openings (1*a*, 1*b*) and a second, blind duct (2) having a single opening (2*a*);

Joining the two half bodies and optional other elements therebetween to yield fluid tight channels (1) and (2);

wherein, the first through duct (1) and the second, blind duct (2) share a common wall, including a section (3) thereof being resiliently flexible.

The "optional other elements" can be a flexible material forming the flexible section (3) in the form of a sheet or a tubular sleeve. As illustrated in FIG. 5, a flexible sheet (3) can be sandwiched between the two half-bodies (5*a*, 5*b*) and joint together with them. In the embodiment of FIG. 5, a first half body (5*a*) comprises an open channel corresponding to the dispensing duct (1) and the channel of the second half body (5*b*) corresponding to the second, blind duct (2). The latter must of course be closed at one end. By thus sandwiching the flexible sheet (3) between the two half-bodies (5*a*, 5*b*), two ducts (1, 2) sharing a common flexible wall (3) are formed.

Alternatively, as illustrated in FIG. 6, the "optional other elements" can be a dispensing duct (1) comprising a first and second relatively rigid sections, separated by a central flexible section (3), the dispensing duct (1) being fitted between the two half bodies, such as to leave an open space between the dispensing duct (1) and the housing's walls, thus defining the second, blind duct (2). The flexible section (3) separating the two relatively rigid sections of the dispensing duct (1) must be located within the housing formed by the two half bodies (5*a*, 5*b*). Where the dispensing tube (1) protrudes from the housing on the side of its second opening (1*b*), care must be taken to fluid tightly seal the joint between the housing and the dispensing duct, to ensure that the second duct (2) is blind. On the contrary, the section of the dispensing tube located on the other side of the flexible section (3) must leave an open space with the walls of the housing to define the opening (2*a*) of the second, blind duct (2).

The housing made of the two half-bodies (5*a*, 5*b*) may be made of any material suitable for this purpose. For ease of recycling of the dispensing device, the housing is advantageously made of the same material as the top chime (33) and bottom stand (34), as well as of the various elements of the dispensing tube (1, 32*a*). Polyolefins such as various grades of PE and PP are particularly advantageous since they have a good mechanical resistance to cost ratio. The two half bodies and optional other elements may be joined by any method known in the art. In particular, glue, ultrasonic-, solvent, or thermal-welding, mechanical fastening means, over-injection of a ribbon of polymer at the joints, etc.

The invention claimed is:

1. A beverage dispensing apparatus for dispensing a beverage comprising:

a pressurized container containing a beverage to be dispensed;

a dispensing duct defined by at least one wall and bringing in fluid communication the liquid beverage contained in the container through a first opening with the exterior via a valve and out of a second opening, for drawing beverage out of the container;

wherein:

at least a section of the at least one wall defining the dispensing duct is resiliently flexible and is such that its inner surface, facing the interior of the dispensing duct, is exposed to the pressure, $P_1$, reigning in the duct at that level, and its outer surface, facing out of the dispensing duct is exposed to a pressure substantially equal to the pressure, $P_2$, reigning in the container, the resiliently flexible section being deformable such as to maintain a substantially constant dispensing flow rate over a given range of operating pressure values, $P_2$, in the container by reducing the cross-section area of the dispensing duct with increasing pressure gradient, $\Delta P_{2-1}$, across the flexible wall section of the ducts, wherein the apparatus further comprises:

a blind duct opening at the interior of the container and sharing at least a wall with the dispensing duct including the flexible section thereof; and wherein the flexible section is not located within the container.

2. The dispensing apparatus according to claim 1, wherein the flexible section is in the form of any of:

(a) a tubular sleeve joining two relatively rigid sections of the dispensing duct;

(b) a flexible sheet closing an open window on the at least one wall defining the dispensing duct; and (c) two or more such windows closed by a flexible sheet distributed along the periphery of a given section of the dispensing duct;

wherein the at least one wall defining the dispensing duct at and adjacent the flexible section comprises planar or curved sections.

3. The dispensing apparatus according to claim 1, wherein the blind duct surrounds the resiliently flexible section is a tubular sleeve.

4. The dispensing apparatus according to claim 1, wherein the container comprises a closure, through which passes the dispensing duct, and the flexible section of the dispensing duct is located either within or downstream from said closure, and the opening to the container of the blind duct is substantially flush with the surface of the closure facing the interior of the container.

5. The dispensing apparatus according to claim 1, wherein the container is pressurized by at least one of the following means;

a pressurized gas cartridge;

a gas adsorbed or absorbed on a carrier medium;

in plant pre-pressurization of the container by injection of a pressurized gas; and/or a compressors;

each of these means being applied such that the pressurized gas is present in, or can be injected upon activation directly into either (a) the container containing the liquid or (b) the inter-space separating an outer container from an inner, flexible bag containing the liquid to be dispensed.

6. The dispensing apparatus according to claim 2, wherein the flexible section of the wall of the dispensing duct is made of a natural or synthetic rubber, a silicone resin, a thermoplastic elastomer (TPE), or is made of the same material as the at least one wall of duct but of substantially thinner section.

7. The dispensing apparatus according to claim 1, wherein the cross section of the dispensing duct outside the flexible section thereof is not constant.

8. The dispensing apparatus according to claim 1, which is a disposable home beer dispenser.

9. A method for producing a flow control means for controlling the flowrate of a liquid flowing through a dispensing duct of a pressure driven beverage dispensing apparatus, said method comprising the following steps:

injection moulding two half bodies of a housing, each half body comprising on their inner surface at least one open channel matching at least one open channel of the other half;

providing an element comprising a resiliently flexible material, said element being selected from:

a sheet or a tubular sleeve made of a resiliently flexible material; or a dispensing duct comprising a flexible section;

bringing the two half bodies, with said elements in between, in abutting relationship with the at least one open channel of one half body vis-à-vis the at least one open channel of the other half body to thus form at least one through duct having a first and second openings and a second, blind duct having a single opening;

joining the two half bodies and said elements therebetween to form a first through duct and a second, blind duct;

wherein the first through duct and the second blind duct share a common wall, including a section thereof being resiliently flexible and formed by the resiliently flexible material of the element.

* * * * *